US006761010B1

(12) United States Patent
Gibson

(10) Patent No.: US 6,761,010 B1
(45) Date of Patent: Jul. 13, 2004

(54) MEDICATION ORGANIZING SYSTEM

(76) Inventor: James B. Gibson, 524 Bayliss Dr., Richmond, VA (US) 23235

( * ) Notice: Subject to any disclaimer, the term of this patent is extended or adjusted under 35 U.S.C. 154(b) by 1 day.

(21) Appl. No.: 10/034,153

(22) Filed: Dec. 26, 2001

(51) Int. Cl.[7] ..... B65B 67/04; B65B 39/00

(52) U.S. Cl. ..... 53/390; 53/246; 53/247; 53/260; 53/284.7; 53/374.8

(58) Field of Search ..... 53/246, 247, 260, 53/267, 268, 284.7, 373.7, 374, 374.9, 390, 562, 570, 459, 473, 509, 374.8; 383/37; 156/583.9; 206/459.5

(56) References Cited

U.S. PATENT DOCUMENTS 2,691,476 A * 10/1954 Petrea ..... 53/570
2,958,172 A * 11/1960 Le Branche ..... 53/509
3,228,167 A * 1/1966 Schmidt ..... 53/284.7
3,340,679 A * 9/1967 Johnson ..... 53/570
3,501,886 A * 3/1970 Watts, Jr. et al. ..... 53/509
3,698,153 A * 10/1972 Lieberman ..... 53/260
3,792,770 A * 2/1974 Freeman ..... 206/409
4,021,290 A * 5/1977 Smith ..... 156/583.9
4,124,966 A * 11/1978 Wilson ..... 53/284.7
4,162,602 A * 7/1979 Achelpohl et al. ..... 53/284.7
4,630,311 A * 12/1986 Bentson ..... 383/37
4,637,060 A * 1/1987 Ausnit ..... 383/37
4,702,289 A * 10/1987 Benner et al. ..... 53/562
4,776,150 A * 10/1988 Siegel ..... 53/390
4,860,899 A * 8/1989 McKee ..... 206/459.5
5,177,937 A * 1/1993 Alden ..... 53/374.8
5,417,261 A * 5/1995 Kanzler et al. ..... 141/313
5,713,182 A * 2/1998 Croft ..... 53/374.2
5,737,902 A * 4/1998 Aylward ..... 53/245
5,752,371 A * 5/1998 Mosley ..... 53/570
5,758,477 A * 6/1998 Wilson et al. ..... 53/260
5,771,665 A * 6/1998 Nelson et al. ..... 53/570
5,813,196 A * 9/1998 Page et al. ..... 53/284.7
6,119,440 A * 9/2000 Benner et al. ..... 53/473
6,151,870 A * 11/2000 Di Bernardo et al. ..... 53/509
6,367,975 B1 * 4/2002 Cronauer et al. ..... 383/37
6,497,083 B1 * 12/2002 Garwood et al. ..... 53/246

* cited by examiner

*Primary Examiner*—John Sipos
*Assistant Examiner*—Louis Huynh
(74) *Attorney, Agent, or Firm*—John H. Thomas, P.C.

(57) ABSTRACT

An improved medication organizing system for allowing patients to rapidly and easily prepare hermetically sealed dosage packages to set up their medication regime for a week, month, or longer period of time. The device includes seven hoppers to allow the patient to prepare a set of hermetically sealed medication packages for a given time for each day of the week. After being filled, each package in the set of seven packages is hermetically sealed simultaneously by simply loading the set into a sealing unit and pulling a lever. Sealing of the packages does not require manual manipulation of the individual packages by the user, such as would be required for medication organizers utilizing individual packages with zip-lock seals. The medication organizing system allows patients who lack manual dexterity, such as elderly patients, to easily prepare medication dosages for an extended period of time. The medication organizing system enables the preparation of small, easily transportable packages of medication that can be quickly and easily filled, sealed, handled, and reopened by any user, including the elderly.

4 Claims, 16 Drawing Sheets

MEDICATION ORGANIZING SYSTEM

FIELD OF THE INVENTION

This invention relates to medication organizers, and particularly to an improved medication organizing system that allows any patient, including the elderly or those having little manual dexterity, to rapidly and easily prepare a hermetically sealed package of tablets, capsules, and the like for each of their required daily dosages.

BACKGROUND OF THE INVENTION

Doctors frequently prescribe a series of daily medications for their patients. These medications are typically prescribed for consumption at a particular time of the day. For example, if a medication must be taken four times per day, then it is common for a patient to consume one tablet in the morning, one at noon, one in the evening, and one at bedtime. Many patients are therefore faced with taking several medications several times a day. A patient therefore must plan his medication regime each day. Frequently, as a result of travel or running daily errands, the medications must be stored in easily transportable and accessible containers to allow the patient to quickly access them when they are needed. Additionally, since many patients who take multiple dosages of medications are elderly, it is helpful that medication organizers be easy to use and not require a lot of manual dexterity by the user.

Early examples of medication organizers typically provided a means of sorting the separate dosages of medication into separate compartments, but the compartments were typically integral with the organizer and therefore not easily transportable. One early example of this type of organizer is that of U.S. Pat. No. 4,318,477 to Kerpe, issued Mar. 9, 1982 (hereinafter the '477 patent). This patent disclosed a pharmaceutical package having a plurality of containers with each container including an open mouth that can swing open and closed. Each container is sufficiently large enough to receive a plurality of medication. The bottom of each container is concave to facilitate easy removal of the medication stored within. The pharmaceutical package of the '477 patent includes a plurality of containers that are integral with the package and therefore, when the user is planning to travel, the entire package must be transported or the individual containers must be emptied and transferred to separate containers.

Later examples of medication organizers typically provided a device for placing the separate dosages of medication into storage containers such as resealable plastic bottles. U.S. Pat. No. 4,749,085 for example, to Denney, issued Jun. 7, 1988 (hereinafter the '085 patent) discloses a rectangular, open-top shallow tray with enclosing side walls and a top panel with markings designating each day of the week equally spaced across the top. A set of pill boxes reside in individual compartments corresponding to each day of the week with each set of pill boxes corresponding to various times of the day. The pill boxes are frictionally and removably held in place in the tray so that each set of the pillboxes can be individually removed to allow a patient to carry one or more days of medication. Although the '085 patent and similar prior art medication organizers provided an adequate means of organizing the separate medication dosages for each dosage period of the day, the resultant storage containers are typically bulky and awkward to carry. If a patient were planning a week long trip away from home, he would likely be required to carry 28 separate bulky packages corresponding to the 4 dosages per day and 7 days that he were planning to be away from home.

Later examples of medication organizers include that of U.S. Pat. No. 6,293,403 to Holmberg, issued Sep. 25, 2001 (hereinafter the '403 patent). This patent discloses a system for organizing, storing, and dispensing a plurality of sets of separate packets corresponding to the days of the week or the dates of the month. The system includes a packet organizer, which may be a tray or a panel, to arrange the sets and subsets of packets by day or date and time of day. The '403 patent discloses the use of packets which may comprise resealable, flexible transparent envelopes, which must be sealed one at a time by the patient.

Although the '403 patent greatly improved the transportability of daily medication dosages, the packets must be sealed individually and therefore require quite a bit of handling by the user. Frequently, elderly people are those most likely to use medication organizers and, in many cases, it may be difficult or nearly impossible for some patients, especially those with arthritic joints in their hands, to seal individual packets by hand. Sealing of individual packets, such as zip-lock packets, usually requires good manual dexterity on the part of the user.

The '403 patent, while providing an adequate means of organizing medications for most individuals having good manual dexterity, does not provide an adequate means for those patients who lack manual dexterity, such as elderly patients. Accordingly, a need therefore exists for a medication organizer that employs small, easily transportable packages of medication that can be quickly and easily filled, sealed, handled, and reopened by any user, including the elderly and those with poor manual dexterity.

SUMMARY OF THE INVENTION

The proposed invention is an improved medication organizing system for allowing patients to rapidly and easily prepare hermetically sealed dosage packages to set up their medication regime for an entire week. The device includes seven hoppers to allow the patient to prepare a set of hermetically sealed medication packages for a given time for each day of the week. After being filled, each package in the set of seven packages is hermetically sealed simultaneously by simply loading the set into a sealing unit and pulling a lever. Sealing of the packages does not require manual manipulation of the individual packages by the user, such as would be required for individual packages with zip-lock seals. Information is printed on the front of the packages to show the day of the week and prompt the user to write in the date and check a block to identify the dosage period of the day. The present invention makes it very convenient for patients to prepare individual dosage packages to set up their medication supply for an entire week. The device has the advantage of creating a hermetically sealed package for each individual dosage period. By creating individual sealed dosage packages, it makes it very easy for patients to grab the correct number of packages for the time they will be away from their house. Since they are not bulky, the packages have the additional advantage of being easy to transport. By being hermetically sealed, the medications are protected from any contaminants. The individual packages within the set of seven packages are separated by perforations, making it easy for a user to separate individual packages when required. Tear areas are provided on each package to provide for easy opening of the sealed packages. The packages are constructed with a measure of stiffness and rigidity and therefore enable easy handling by the user.

INDEX TO REFERENCE NUMERALS IN DRAWING

Figure 1:
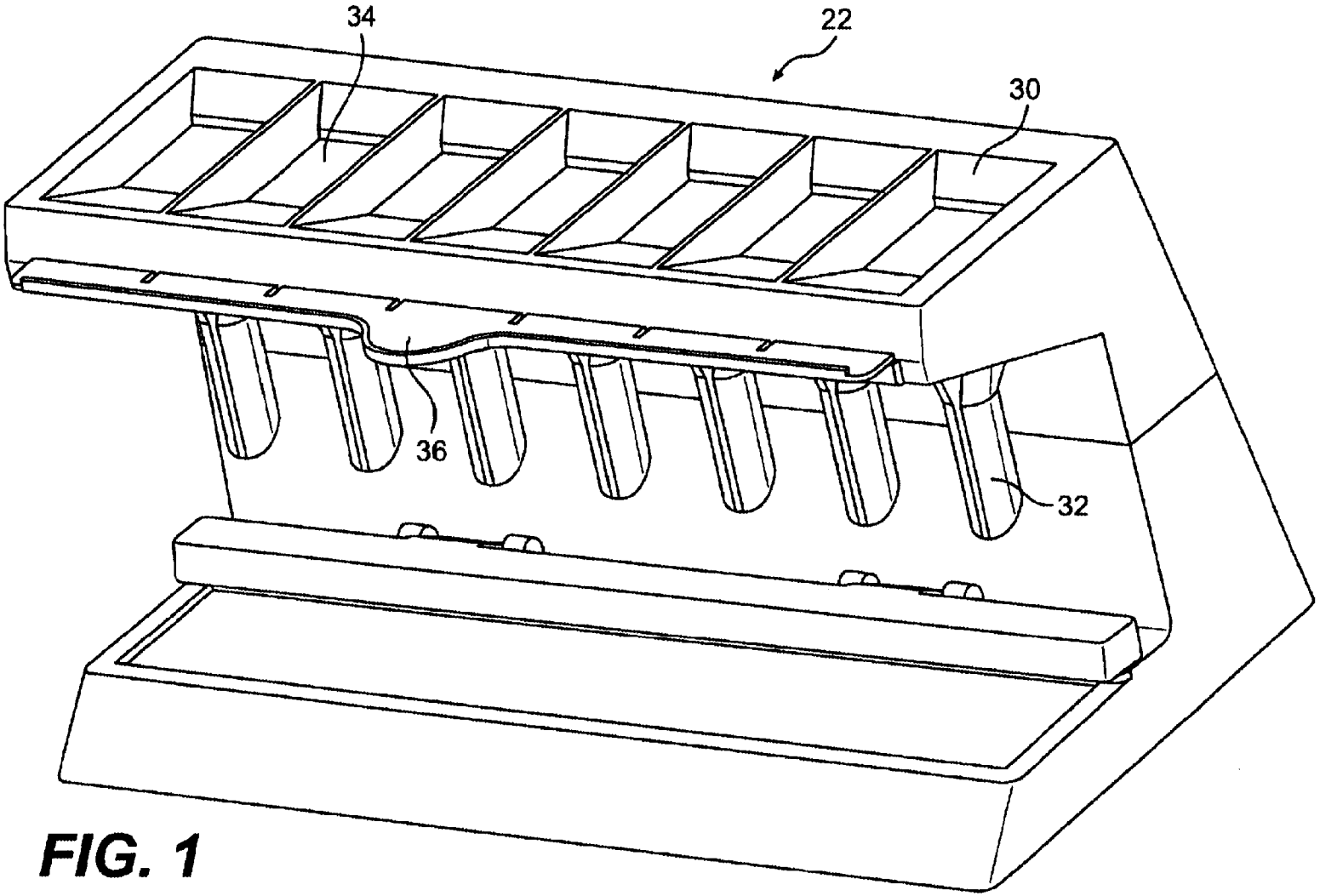
FIG. 1 is a perspective view of the preferred embodiment of the medication organizing and dispensing unit and the sealing unit of the present invention with the hopper doors in the normally closed position.

20 medication organizing system
22 medication sorting and dispensing unit
24 base section
26 top section
28 bottom surface
30 hopper
32 vertical nozzle
34 hopper door
36 handle (of hopper)
38 multi-compartmented container
40 sealing unit
42 cover (of sealing unit)
44 top (of cover)
46 shelf
47 passageway
48 hinge
50 heating element
52 heat sensor
54 packages
56 front wall
58 rear wall
60 overlap
62 lateral seams
64 longitudinal seam
66 bottom (of the container)
68 opening
70 top (of the container)
72 perforations
74 tear notches
76 printed characters
78 day of the week
80 date prompt
82 selection blocks
84 U-shaped notch
86 inner front layer
88 outer front layer
90 rear layer
92 angled end (of nozzle)
94 gusset
96 medications
98 stops
100 light or LED
102 date

DETAILED DESCRIPTION OF THE INVENTION

Figure 8:
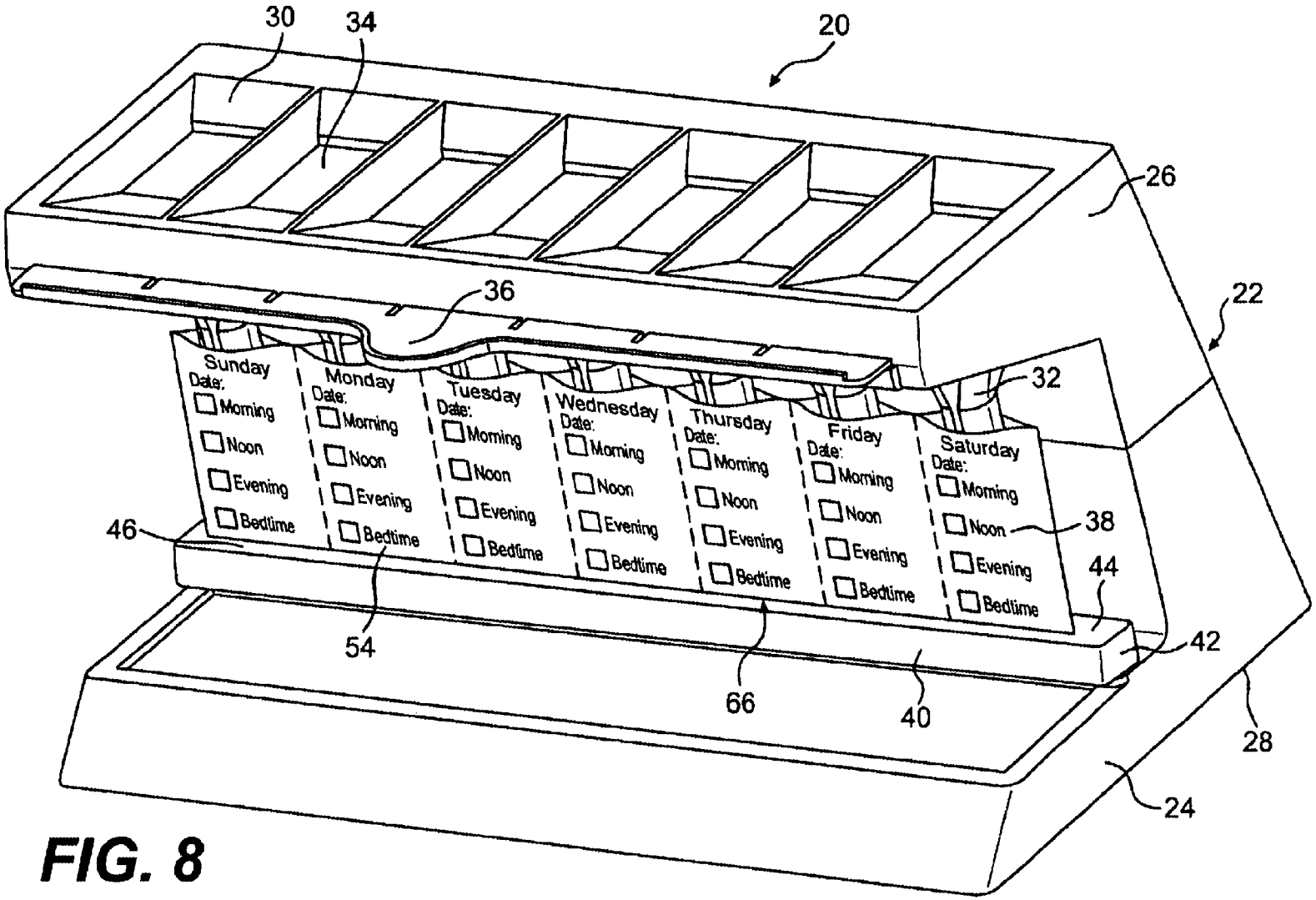
FIG. 8 is a perspective view of the medication organizing system with a multi-compartmented container loaded on the nozzles and with the hopper door closed.

A perspective view of the preferred embodiment of a medication organizing system 20 according to the present invention is shown in FIG. 8. The medication organizing system 20 includes a medication sorting and dispensing unit 22 having a base section 24 and a top section 26. The base section 24 includes a flat bottom surface 28 to permit placement of the dispensing unit 22 on a piece of furniture such as the top of a table or dresser. A plurality of hoppers 30 is arranged in a line along the top section 26. A vertical nozzle 32, a portion of which is visible in FIG. 8, is attached to each hopper 30 and a plurality of hopper doors 34 is disposed at the bottom of each hopper 30. The hopper doors 34, which are depicted closed in FIG. 8, have a common handle 36. The medication organizing system 20 includes a multi-compartmented container 38 that can be lifted and fitted onto the nozzles 32 as shown. The medication organizing system 20 also includes a sealing unit 40 with a cover 42 that is depicted closed in FIG. 8. The top 44 of the cover 42 serves as a shelf 46 for supporting the multi-compartmented container 38 when it is lifted and fitted onto the nozzles 32.

Referring to the perspective view of the medication sorting and dispensing unit 22 shown in FIG. 1, each of the vertical nozzles 32 extends from one of the hoppers 30. The dispensing unit 22 in FIG. 1 is depicted with the handle 36 pushed in and all of the hopper doors 34 closed.

Figure 2:
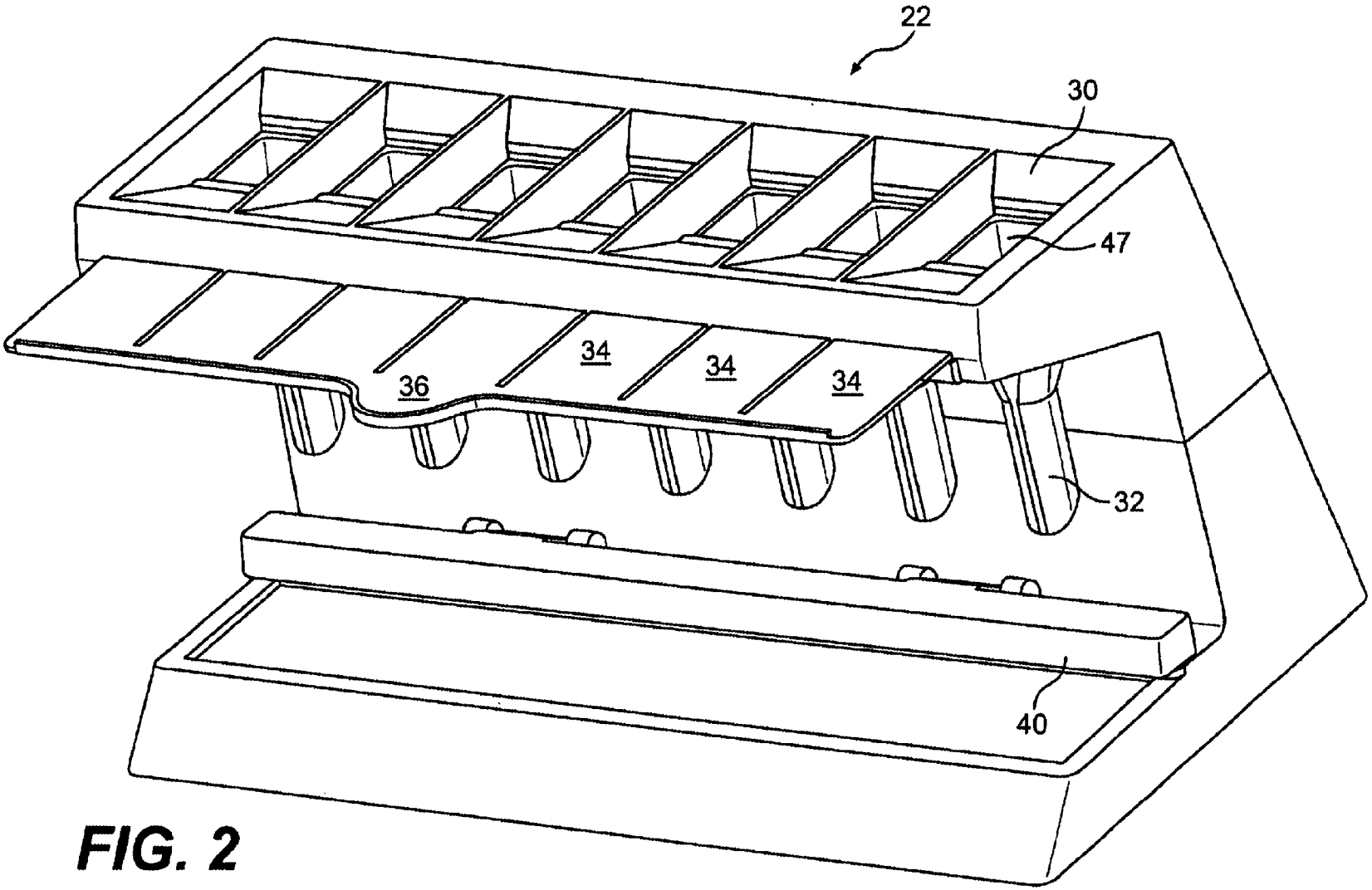
FIG. 2 is a perspective view of the medication organizing and dispensing unit and the sealing unit of FIG. 1 with the hopper doors open and the sealing unit cover closed.

When the common handle 36 is pulled out, as shown in FIG. 2, all of the hopper doors 34 are open, thereby opening a passageway 47 between each hopper 30 and its associated nozzle 32.

Figure 3:
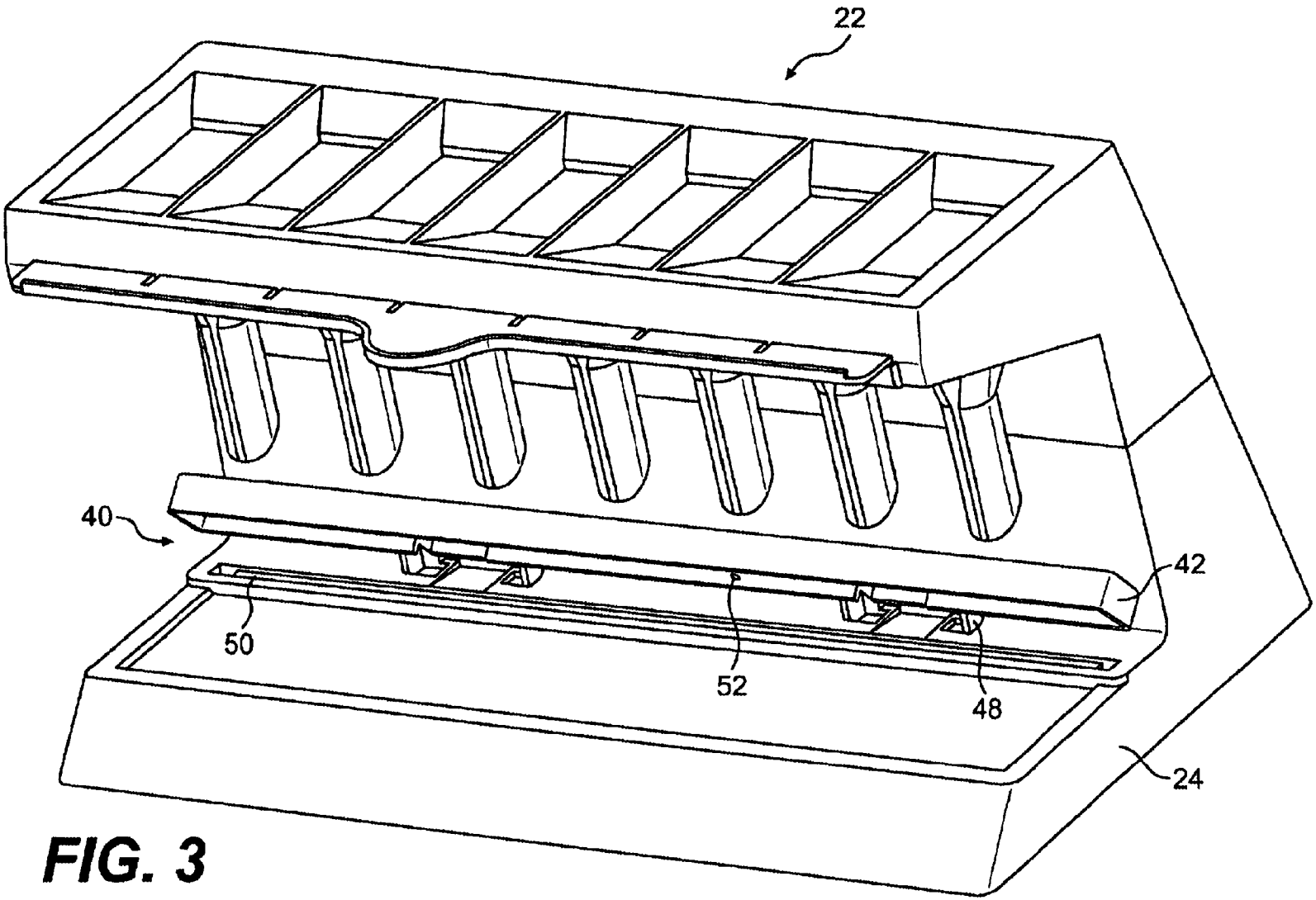
FIG. 3 is a perspective view of the medication organizing and dispensing unit and the sealing unit of FIG. 1 with the sealing unit cover open.

Referring to FIG. 3, the cover 42 of the sealing unit 40 is connected by hinges 48 to the base section 24. The sealing unit 40 includes an heating element 50 that is connected to an electrical source. A heat sensor 52 is located in the cover 42 of the sealing unit 40. The cover 42 is normally latched in the closed position.

Figure 4:
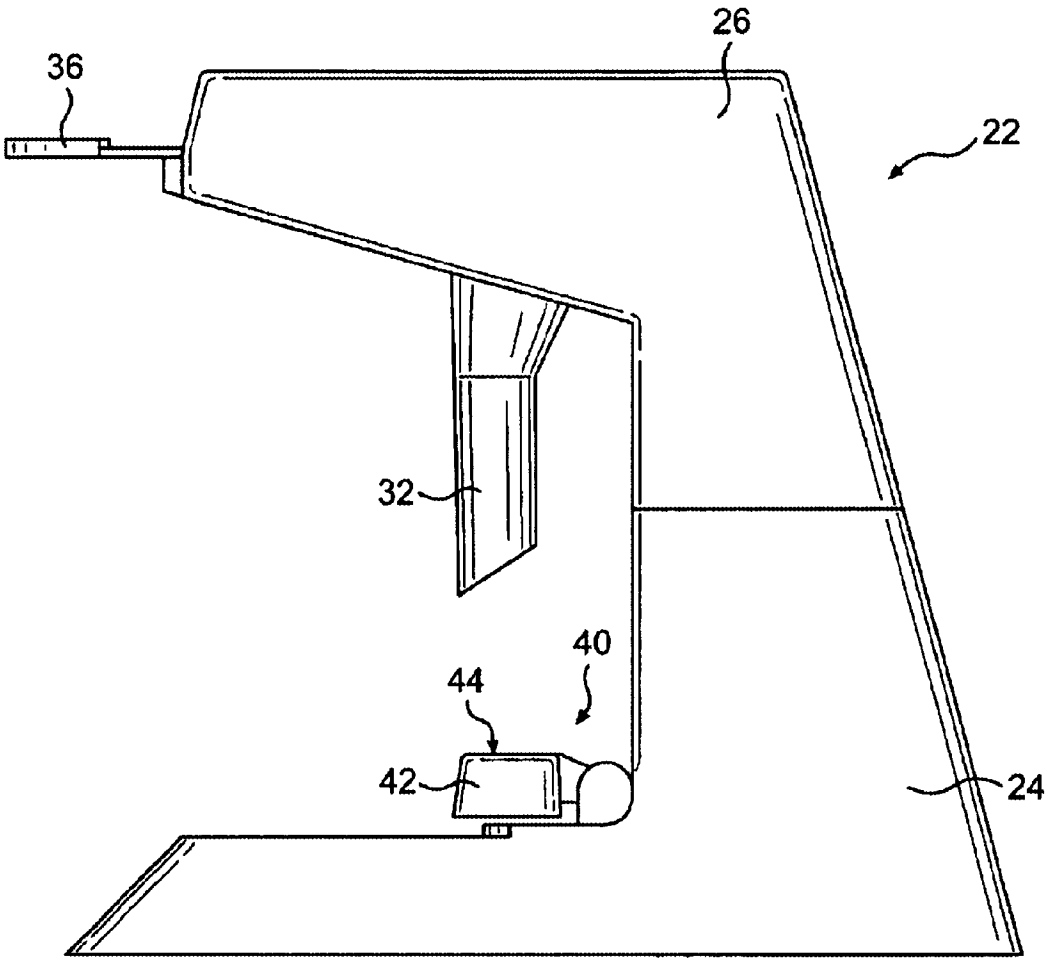
FIG. 4 is a side view of the medication organizing and dispensing unit and sealing unit of FIG. 1.

A side view of the medication sorting and dispensing unit 22 in FIG. 4 shows the nozzles 32 are aligned with the top 44 of the cover 42. The common handle 36 for the hopper doors (not shown) is shown extending from the top section 26 of the dispensing unit 22.

Figure 5:
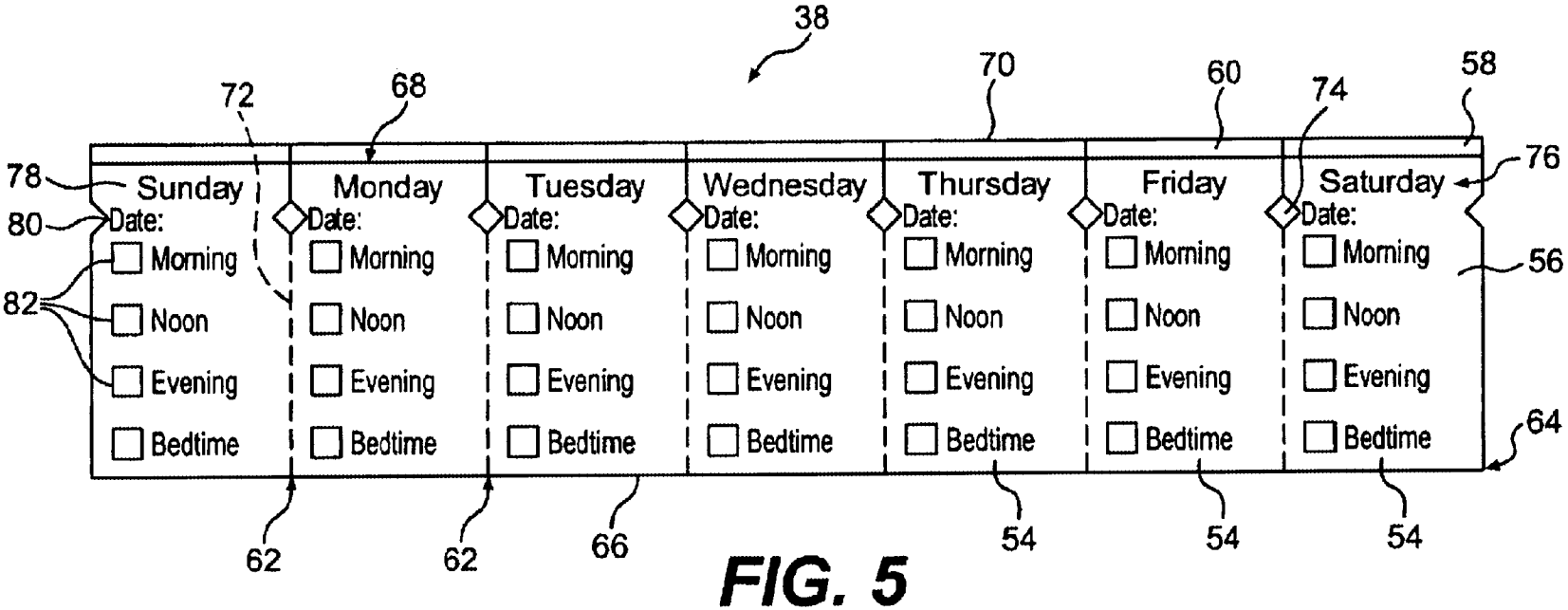
FIG. 5 is a plan view of a multi-compartmented container for use with the medication organizer of FIG. 1.
Figure 6:
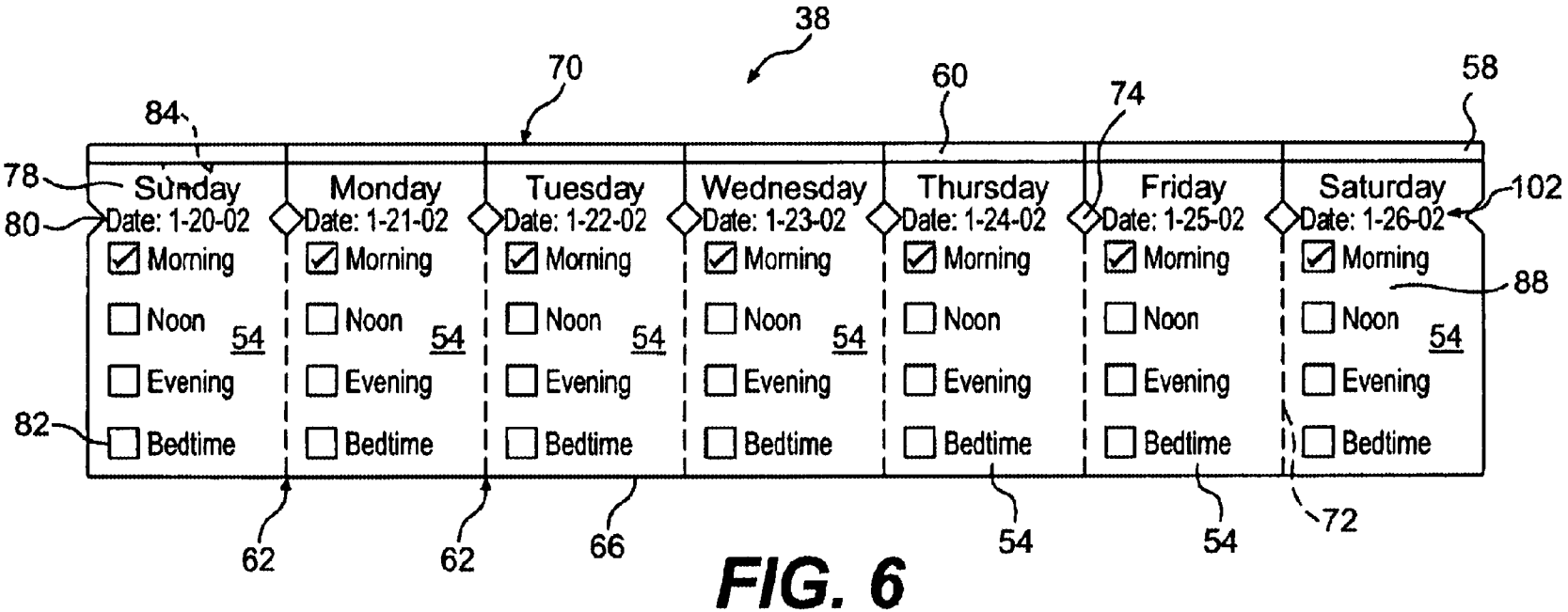
FIG. 6 is a plan view of multi-compartmented container of FIG. 5 in which the individual packages have been annotated with the date and time of the day.

Referring to FIG. 5, the multi-compartmented container 38 consists of a plurality of packages 54 arranged side by side. The container 38 includes an elongated front wall 56 comprised of one or more layers and an elongated rear wall 58 comprised of one or more layers. As shown by the overlap 60 depicted in FIG. 5, the rear wall 58 is typically wider than the front wall 56 to facilitate easy opening of the individual packages 54 when they are fitted to the nozzles (not shown) of the medication sorting and dispensing unit (not shown). The multi-compartmented container 38 is divided into separate packages 54 by the lateral seams 62 spaced longitudinally along the container 38. The individual packages 54 include longitudinal seams 64 at the bottom 66 of the container 38 and have an opening 68 at the top 70 of the container where the rear wall 58 overlaps the front wall 56. Perforations 72 are formed along the lateral seams 62 to facilitate easy separation of the individual packages 54 when desired. Tear notches 74 are provided near the top 70 of the packages 54 to enable effortless opening of the packages 54. The tear notches 74 which facilitate easy tearing and opening of the packages could easily be small slits or die-cuts partially through the wall thickness of the front and rear walls. The tear notches 74 typically do not extend beyond the lateral seams 62 so that, once the packages 54 are sealed, the integrity of the sealed packages 54 is maintained until torn by the user. The individual packages 54 also include printed characters 76 to designate the day of the week 78, a date prompt 80 consisting of the word "date:" followed by a space to prompt the user to write in the date the medication package 54 is intended for, and four selection blocks 82 plus printing identifying the four typical dosage periods of each day. After the individual packages 54 are filled with medication in the form of tablets, capsules, and the like (not shown), and the date has been written on the package 54 and the dosage period selection block 82 checked, the user can easily separate the packages 54 as needed. At this time all the pertinent information identifying the date and time of the dosage will be on each individual package 54. An example depicting the multi-compartmented container 38 with the pertinent information entered by the user is depicted in FIG. 6. The individual packages 54 may also have a U-shaped notch 84, as shown in the far left package in FIG. 6, in the front wall 56 extending from the opening 68 to enable easier opening of the packages.

Figure 7:
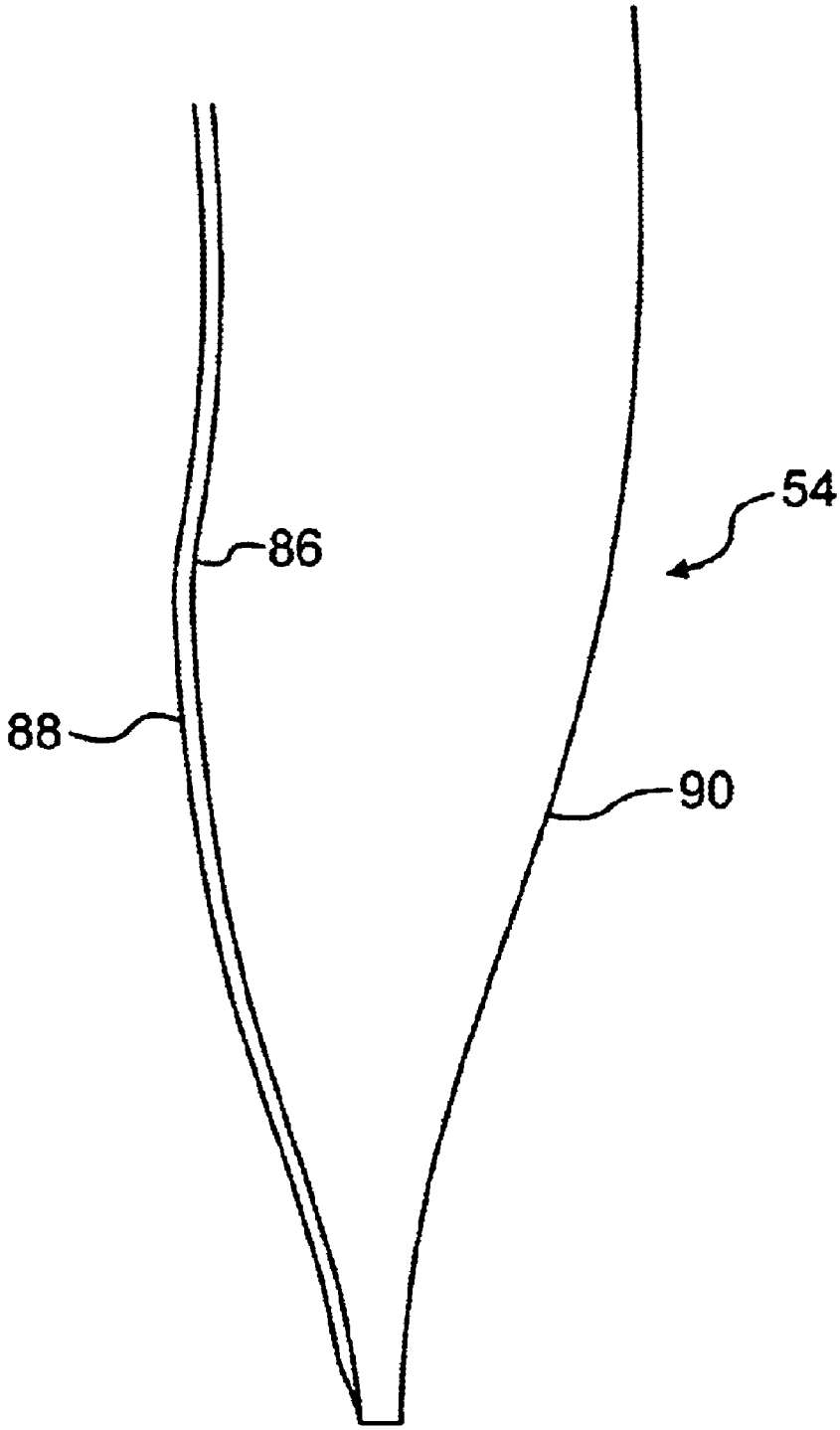
FIG. 7 is a side sectional view of a package taken along lines 7—7 of FIG. 6.

A side sectional view of an individual package 54 is depicted in FIG. 7. Preferably the packages 54 are constructed of two front layers, including an inner front layer 86 and an outer front layer 88, and a single rear layer 90. The preferred materials of construction are Surlyn™ for the inner front layer 86, aluminum foil for the outer front layer 88, and Surlyn™ for the rear layer 90. The multi-compartmented container (not shown) may, however, be constructed with a single front layer and a single rear layer and many different foils and plastics would be acceptable for construction of these layers.

FIGS. 8 through 16 illustrate the sequence of events as the medication organizing system 20 is used to prepare daily medication packages for an individual. It should be noted that the medication organizing system is designed to be simple to operate and to be used by any individual including elderly people or those who may be lacking in manual dexterity. There are many examples in the prior art of medication organizing devices that employ small objects such as bottles, bags, or packets. These devices may require individual handling and placement of up to 28 of these small objects to provide medication for the 7 days and 4 dosage periods in a typical week. The present invention reduces the amount of handling and therefore reduces the time involved to prepare the individual dosage packages by providing a simple medication sorting and dispensing unit coupled with a multi-compartmented container and a sealing unit that seals a plurality of packages at one time. This saves a lot of time over medication organizers that require an individual to seal 28 packages individually to prepare one week's worth of dosages.

To illustrate the operation of the medication organizing system 20, refer now to FIG. 8, which depicts the medication sorting and dispensing unit 22 that has been loaded with an empty multi-compartmented container 38. The container 38 has been lifted and fitted onto the vertical nozzles 32 until the bottom 66 of the container 38 rests upon the shelf 46 created by the closed top 44 of the cover 42. As a result of the design, the dimensions, and the materials of construction of the container 38 and the medication sorting and dispensing unit 22, the container sits upright on the shelf 46 and remains in place, with the individual packages 54 held around the nozzles 32.

Figure 12:
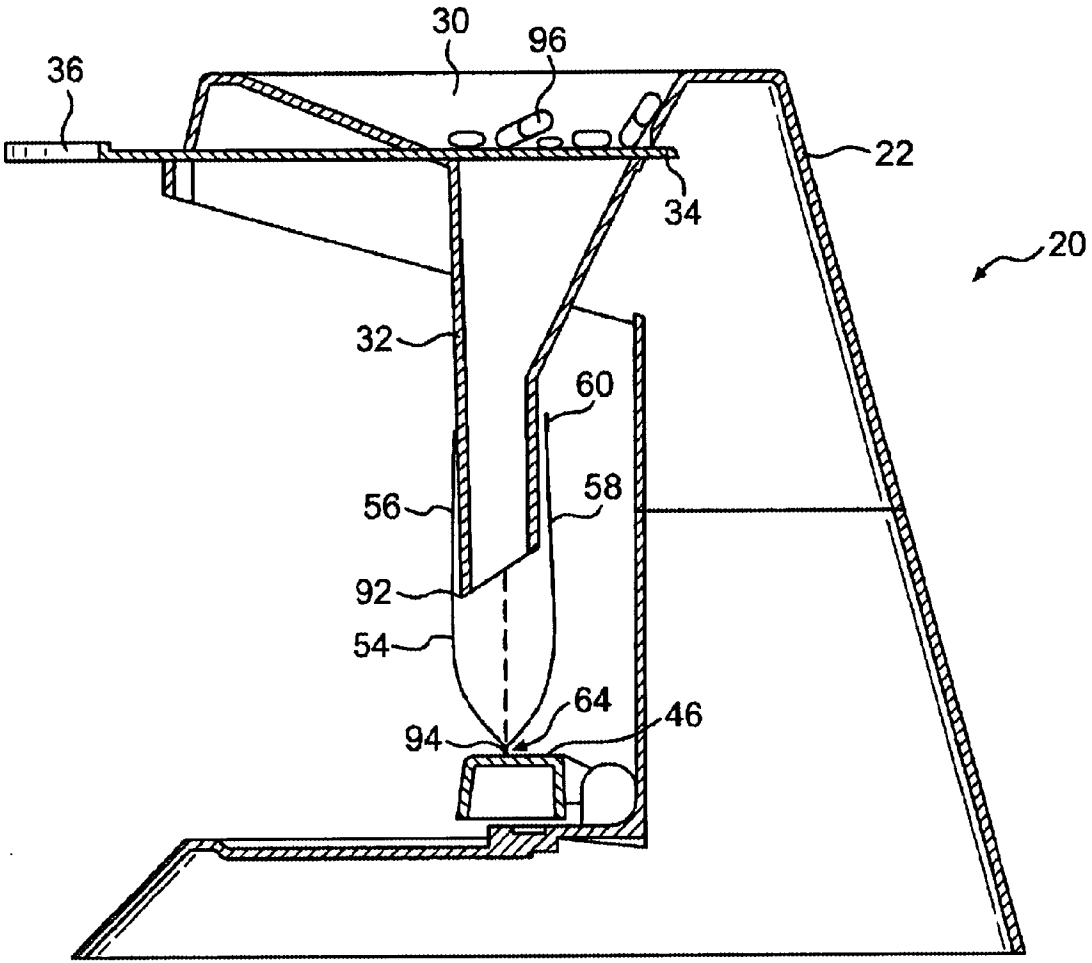
FIG. 12 is a side sectional view of an individual filling section of the medication organizing system with the hopper door closed and medication loaded into the hopper.
Figure 13:
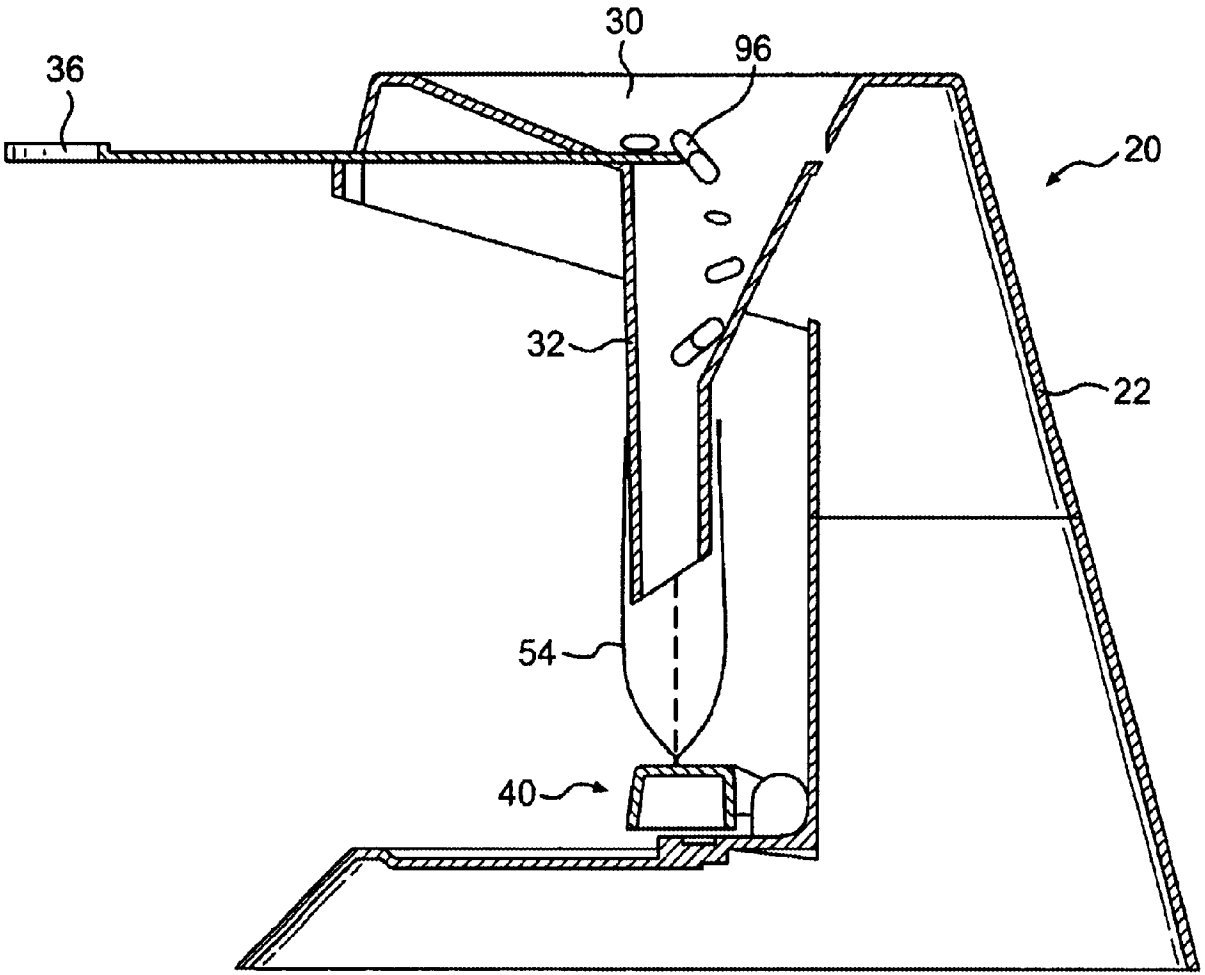
FIG. 13 is a side sectional view of an individual filling section of the medication organizing system with the hopper door partially open and medication falling into the nozzle.

Referring now to FIG. 12, a side sectional view of the medication sorting and dispensing unit 22 and an individual package 54, when first lifted upon the nozzles 32, the nozzles 32 easily enter the package as a result of the angled end 92 of the nozzle, the overlap 60 between the rear wall 58 and the front wall 56, and the construction details of the packages 54. The packages 54 may, for example, include a gusset 94 at the location of the longitudinal seam 64 at the bottom of each package 54. The packages 54 rest upon the shelf 46 after they are fit onto the nozzles 32. As depicted in FIG. 12, the nozzles 32 extend approximately halfway into the packages 54 after they are fitted thereon and rest on the shelf 46. As shown in FIG. 12, at this point the handle 36 is pushed in and the hopper doors 34 are closed. The user would then load medications 96 such as tablets, caplets, capsules, gel tabs, or the like into each hopper 30.

Figure 9:
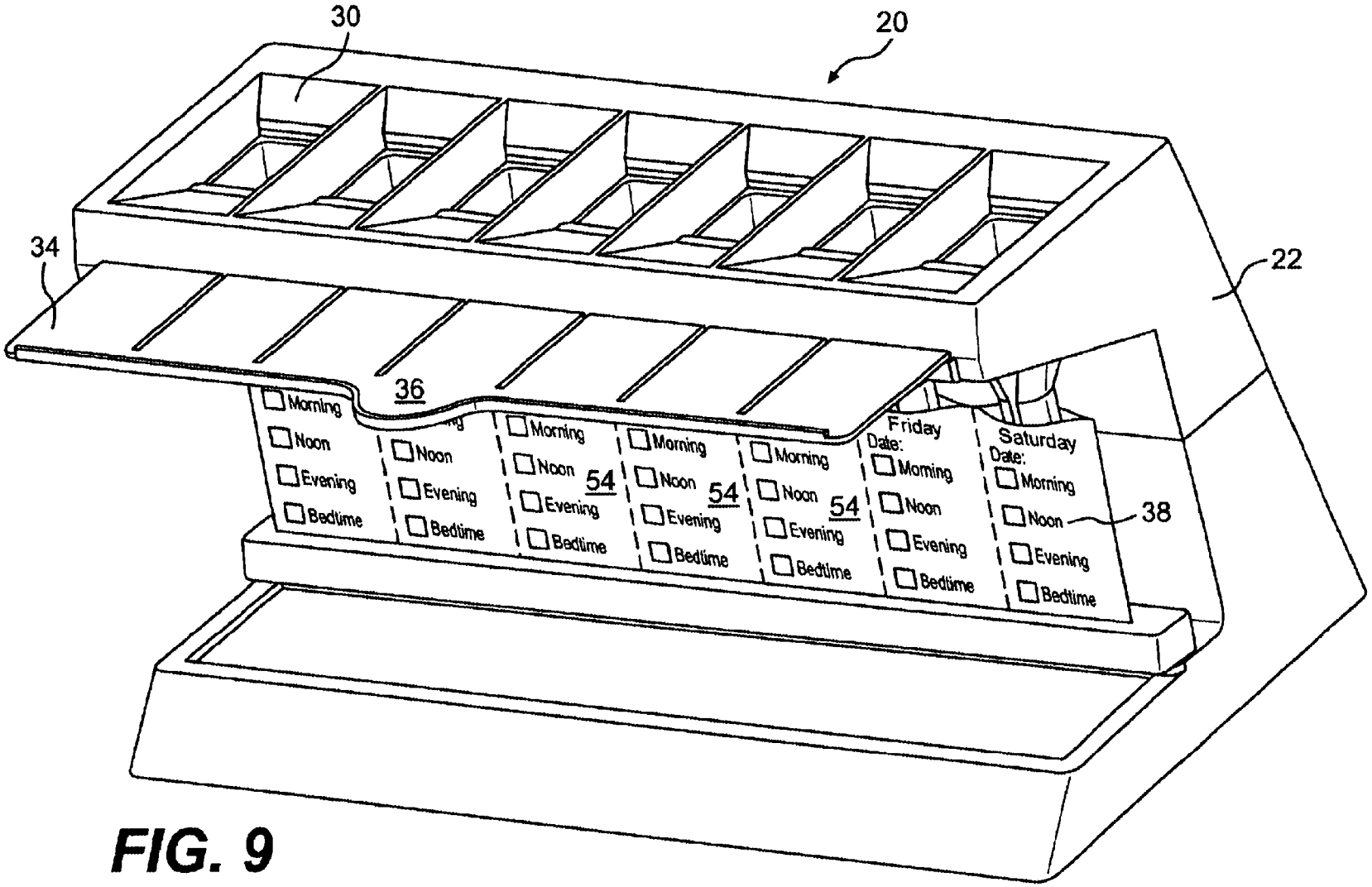
FIG. 9 is a perspective view of a preferred embodiment of the medication organizing system with a multi-compartment container loaded on the nozzles and with the hopper door open.

Referring now to FIG. 9, after all the hoppers 30 have been filled with medications (not shown), the common handle 36 connected to the hopper doors 34 is pulled out. The medications (not shown) that have been loaded into the individual hoppers 30 fall into the individual packages 54 in the multi-compartmented container 38. This is also illustrated in the side sectional view of FIG. 13, where the handle 36 is depicted pulled out and the medications 96 are caused to fall by gravity into the individual packages 54.

Figure 14:
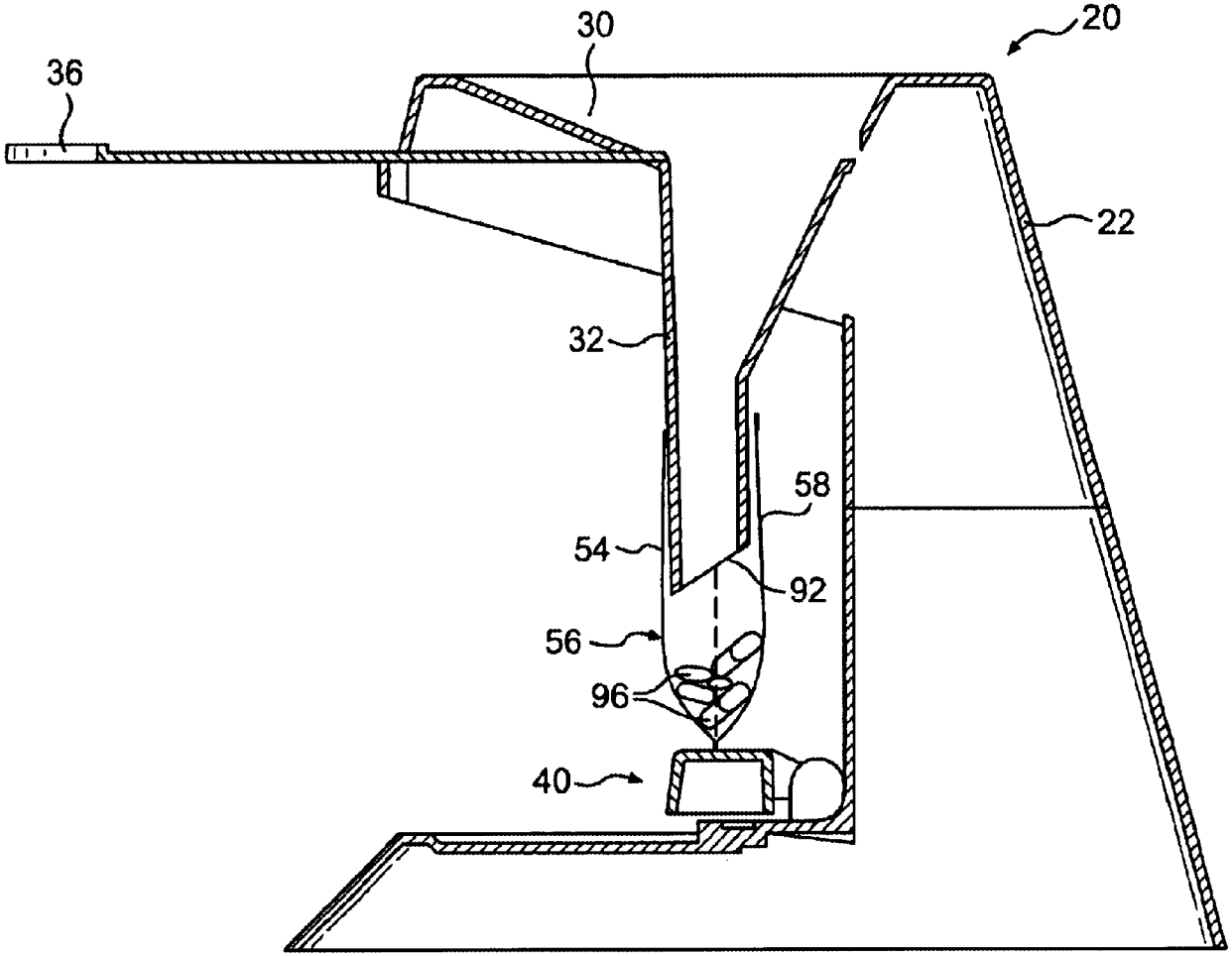
FIG. 14 is a side sectional view of an individual filling section of the medication organizing system with the hopper door fully open and medication falling into the package.

Referring to FIG. 14, after the medications 96 have fallen into the individual packages 54 they are concentrated in the lower portion of the packages 54 as shown. The angled end 92, being shorter on the rear side of the nozzle 32, allows the packages to slip easily off of the nozzle 32 as a result of the rear wall 58 of the package 54 clearing the nozzle 32 prior to the front wall 56.

Figure 10:
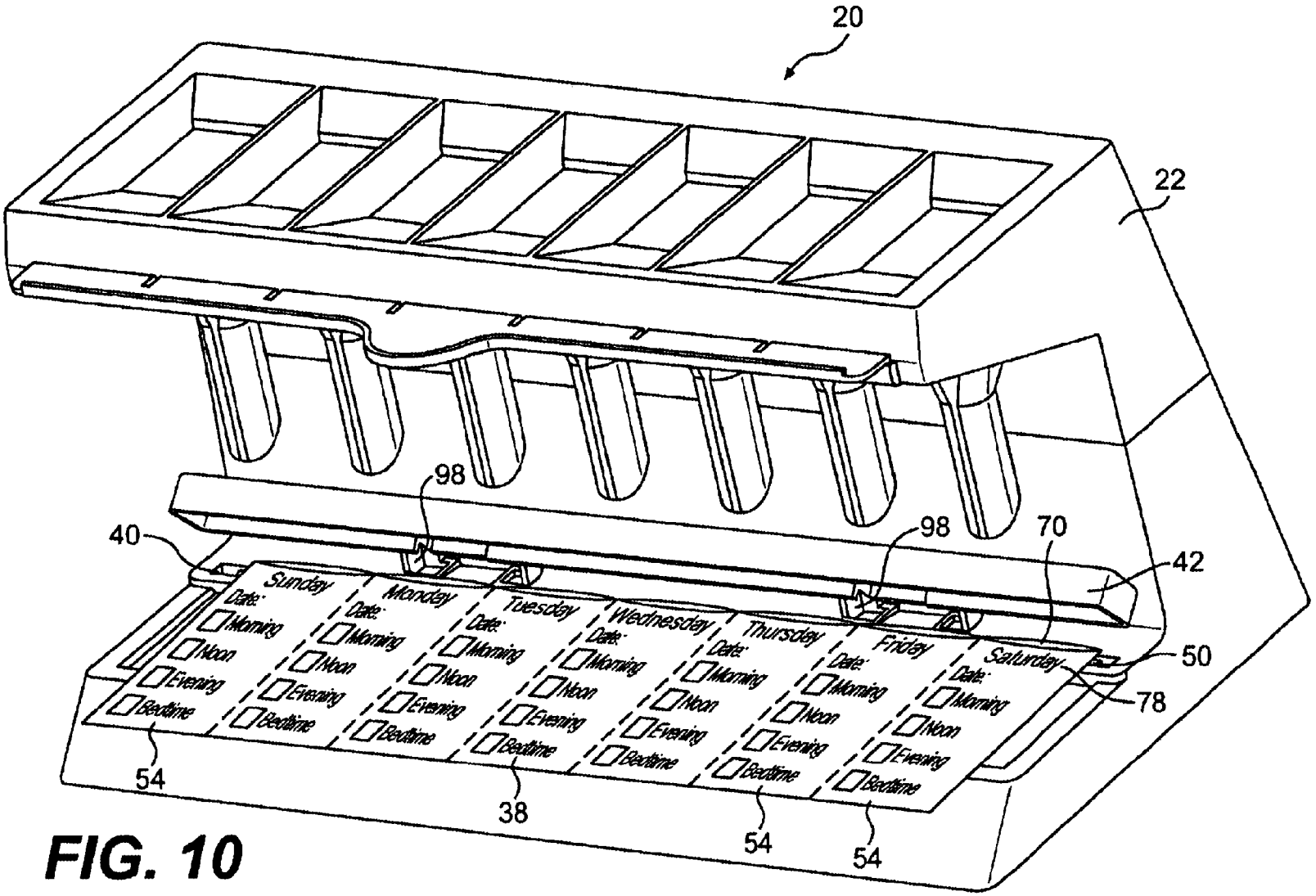
FIG. 10 is a perspective view of the medication organizing system of FIG. 8 with a multi-compartment container loaded into the heat sealing unit.
Figure 15:
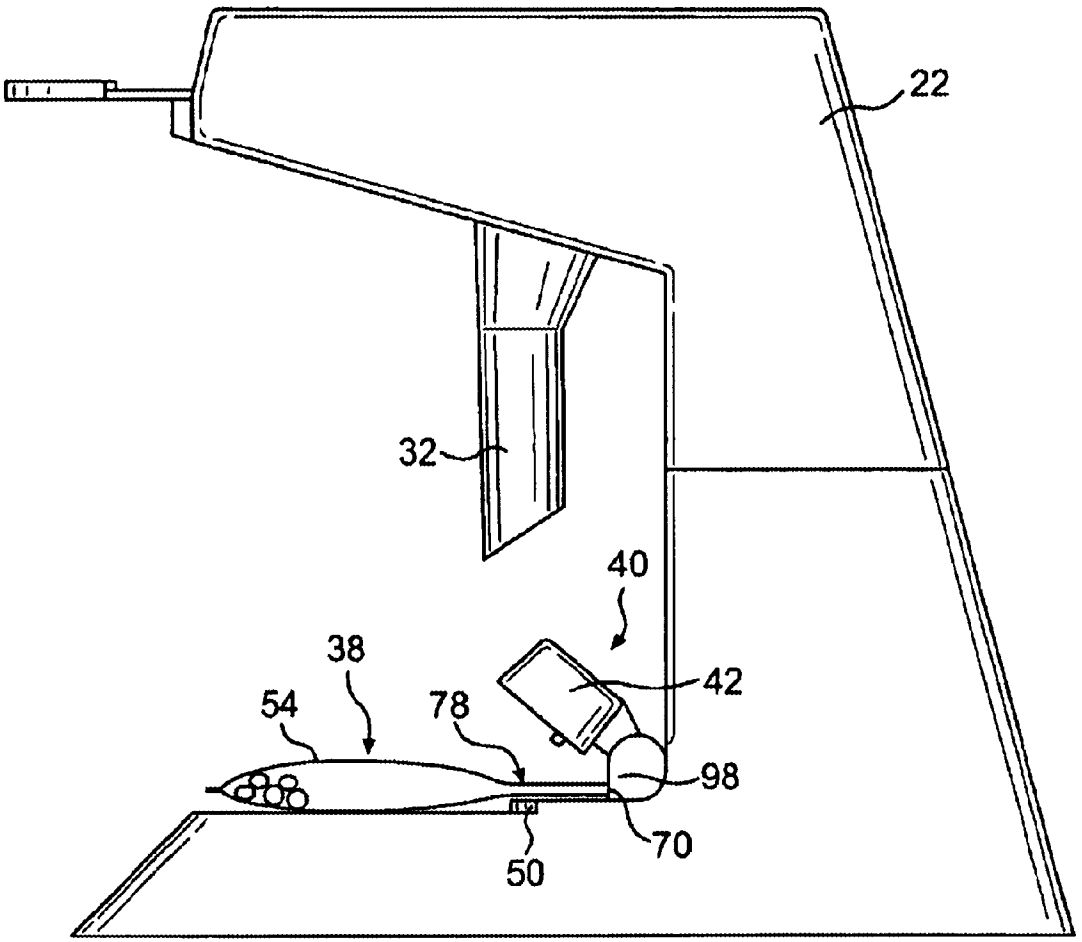
FIG. 15 is a side view of the medication organizing system showing the sealing unit cover open and a multi-compartment container loaded into the sealing unit.

Referring to FIG. 10 and FIG. 15, after the packages 54 have been filled, the cover 42 of the sealing unit 40 is opened to expose the heating element 50. The multi-compartmented container 38 is then turned on its side and laid across the heating element 50 with the top 70 of the container 38 against the stops 98 at the back of the sealing unit 40. When fully inserted into the sealing unit 40 as depicted, the heating element 50 is underneath the portion of the individual packages 54 having the day of the week 78 printed thereon.

Figure 11:
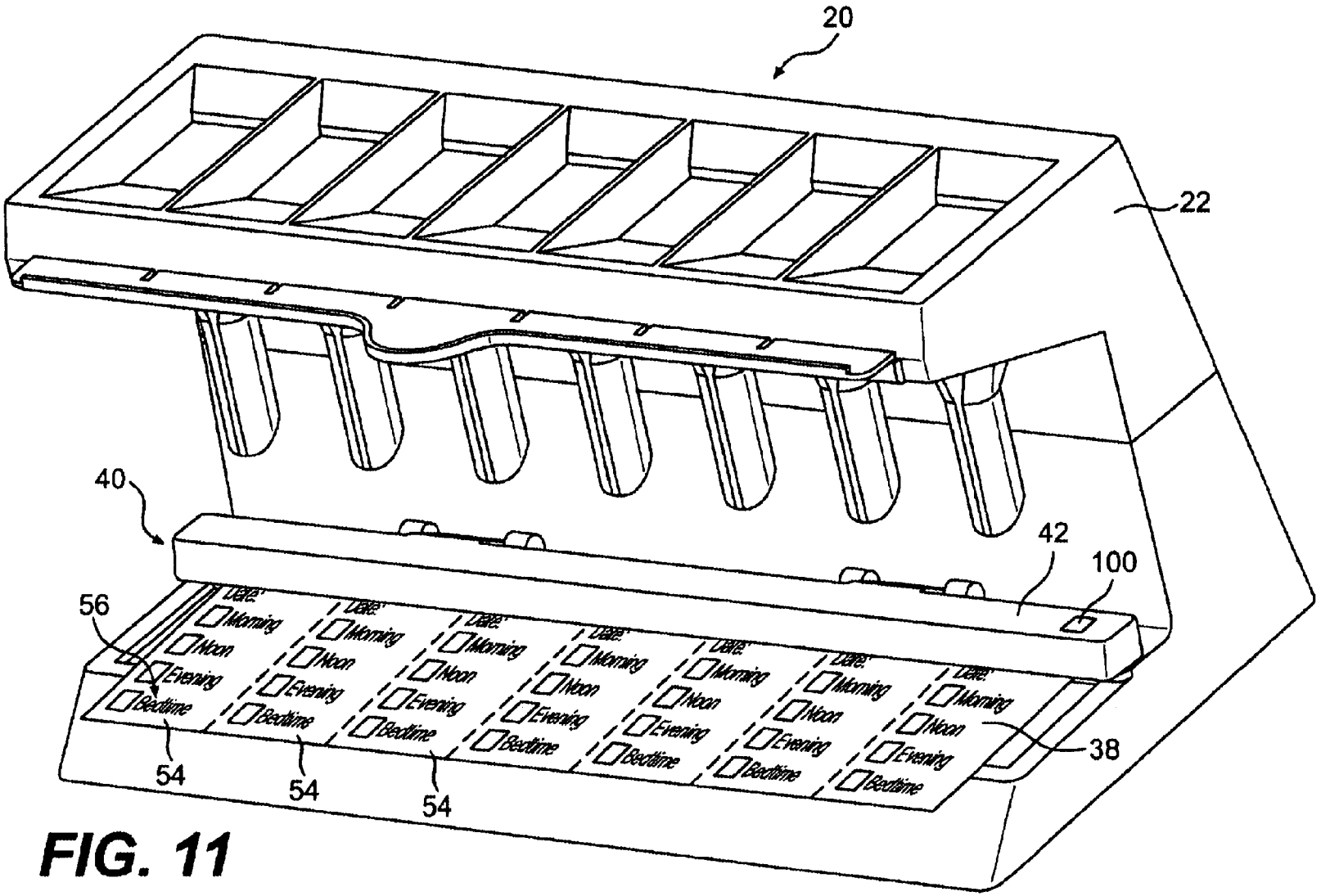
FIG. 11 is a perspective view of the medication organizing system of FIG. 8 with a multi-compartment container being sealed by the heat sealing unit.
Figure 16:
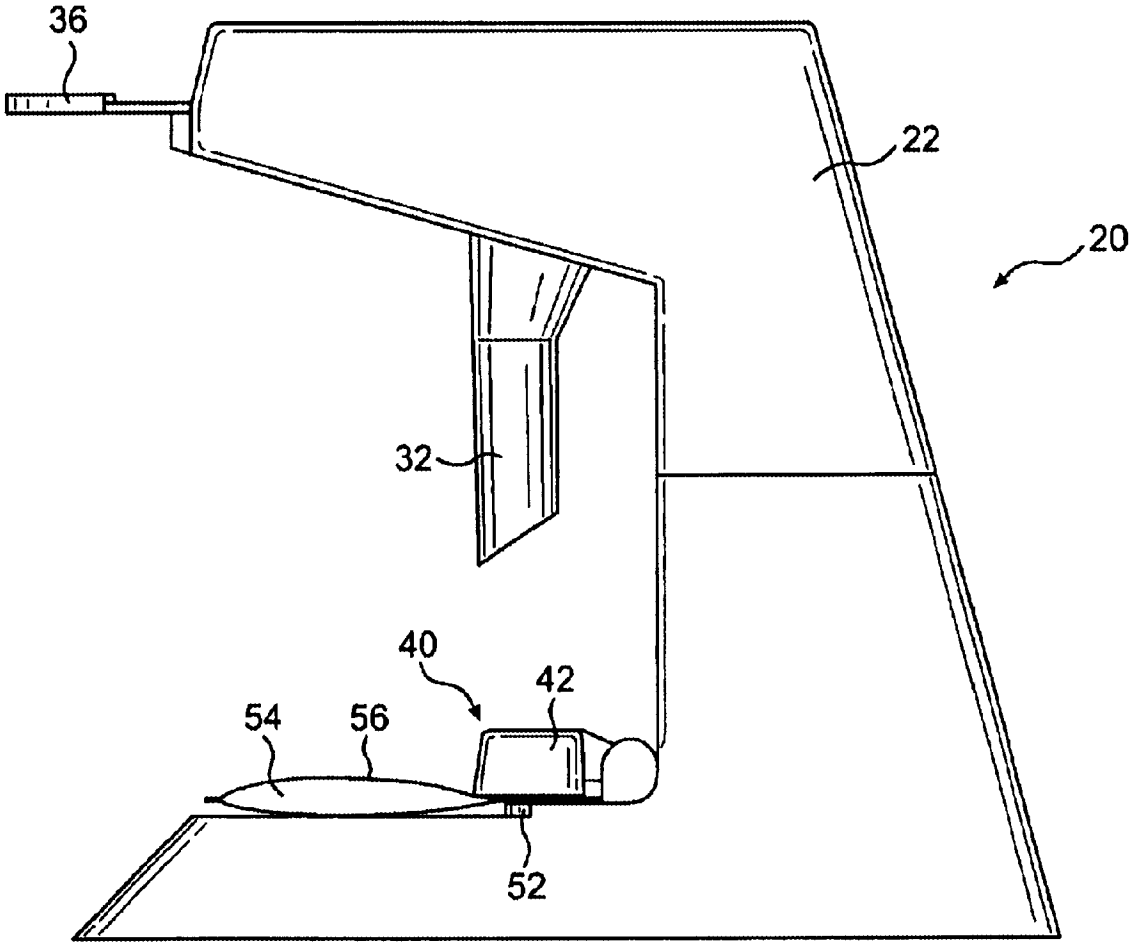
FIG. 16 is a side view of the medication organizing system showing the sealing unit cover closed and sealing a multi-compartment container.

Referring to FIG. 11 and FIG. 16, the cover 42 of the sealing unit 40 is then closed and held closed until the light or LED 100 illuminates thereby signifying that the heat sensor 52 has detected that the front wall 56 of the packages 54 have reached an appropriate temperature to effectively seal them. The light or LED 100 (FIG. 11) would typically be mounted on the cover 42 as shown but also could be mounted anywhere on the medication sorting and dispensing unit 22 that is conspicuous and easily viewed by the user when the container 38 is in place in the sealing unit 40. The light or LED 100 is also constructed of a large enough size to make it conspicuous and easily visible to an elderly user.

Referring again to FIG. 6, the net result of applying the present invention, the medication organizing system, is a sealed multi-compartmented container 38 composed of individual sealed packages 54. As the outer front layer 88 of the container 38 is typically constructed of aluminum foil, the medications are not observable from the front of the packages 54 as shown. The outer front layer is ink receptive, allowing the user to enter the date 102 and check the selection block 82 to identify the dosage period, as shown.

Referring to FIG. 6, since the rear wall 58 is typically constructed of Surlyn™ or polyethylene, the medications (not shown) are visible from the rear of the packages 54. By tearing along the perforations 72 the packages 54 can be separated from the container 38. The design and arrangement of the multi-compartmented container 38 and the individual packages 54 therefore enable the user to easily separate the desired amount of packages required to cover his or her medication needs for the time they are planning to be away from home. The individual packages have the advantage of being very compact and easy to carry. The packages 54 are preferably 1.625 inches wide by 2.75 inches long. The width of an individual package 54 is measured between the lateral seams 62 and the length is measured from the bottom 66 to the top 70 of the container.

Although the description above contains many specific descriptions and typical materials of construction, these should not be construed as limiting the scope of the invention but as merely providing illustrations of some of the presently preferred embodiments of this invention.

Thus the scope of the invention should be determined by the appended claims and their legal equivalents, rather than by the examples given.

What is claimed is:

1. A medication organizing system for manually preparing sealed packages of medication for daily dosages comprising:

a plurality of hoppers in a linear arrangement;

a plurality of nozzles, each of said nozzels associated with a corresponding one of ad hoppers;

a passageway between each of said hoppers and the associated nozzle;

a manually operated hopper door for simultaneously opening said passageways between each of said hoppers and the associated nozzle;

a multi-compartmented container, said multi-compartmented container comprising a plurality of bags in a linear arrangement, said bags being of a size and alignment to allow each of said bags to conform to and envelope one of said nozzles such that each of said bags can receive at least one pill from the associated hopper, and a heat sealing arrangement for simultaneously sealing each of said bags.

2. The medication organizing system of claim 1 wherein said packages are preferably 1.625 inches wide and 2.75 inches deep.

3. The medication organizing system of claim 1 wherein said sealing arrangement is a heat sealing unit comprising:

a metal strip capable of being electrically heated;

a hinged cover;

a heat sensor disposed within said cover; and a light or LED connected to said sensor, said light or LED changing state when said sensor detects that the packages have achieved an optimal sealing temperature.

4. The medication organizing system of claim 1 wherein said nozzles have an angled surface at the discharge end.

* * * * *